US006757988B2

(12) United States Patent
Bruntz et al.

(10) Patent No.: US 6,757,988 B2
(45) Date of Patent: Jul. 6, 2004

(54) CONTROL SYSTEM FOR A CLOTHES DRYER HEATER

(75) Inventors: Jordan S. Bruntz, Baxter, IA (US); Joel L. Herr, Newton, IA (US)

(73) Assignee: Maytag Corporation, Newton, IA (US)

( * ) Notice: Subject to any disclaimer, the term of this patent is extended or adjusted under 35 U.S.C. 154(b) by 3 days.

(21) Appl. No.: 10/152,012

(22) Filed: May 22, 2002

(65) Prior Publication Data

US 2003/0217480 A1 Nov. 27, 2003

(51) Int. Cl.[7] ..... F26B 21/06
(52) U.S. Cl. ..... 34/543; 219/492
(58) Field of Search ..... 34/543, 524, 549, 34/553; 236/68 B, 68 D; 219/486, 492, 494, 510

(56) References Cited

U.S. PATENT DOCUMENTS

| | | | | |
|---|---|---|---|---|
| 2,851,790 A | | 9/1958 | Worst | |
| 2,919,493 A | | 1/1960 | Candor | |
| 3,050,865 A | * | 7/1962 | Morey | 34/45 |
| 3,286,361 A | | 11/1966 | Cobb et al. | |
| 3,409,994 A | | 11/1968 | Menk | |
| 3,508,340 A | | 4/1970 | Kombol | |
| 3,557,342 A | * | 1/1971 | Chambers | 219/499 |
| 3,571,941 A | | 3/1971 | Garfield et al. | |
| 3,612,500 A | | 10/1971 | Cramer et al. | |
| 4,083,118 A | * | 4/1978 | Cotton | 34/53 |
| 4,197,717 A | * | 4/1980 | Schumacher | 62/213 |
| 4,226,026 A | * | 10/1980 | Deming et al. | 34/31 |
| 4,586,267 A | | 5/1986 | Sussman | |
| 4,827,627 A | | 5/1989 | Cardoso | |
| 4,842,192 A | | 6/1989 | Range et al. | |
| 5,443,541 A | | 8/1995 | St. Louis | |
| 5,978,995 A | | 11/1999 | Bruntz et al. | |
| 6,047,486 A | | 4/2000 | Reck et al. | |
| 6,064,043 A | * | 5/2000 | Livers, Jr. et al. | 219/492 |
| 6,199,300 B1 | * | 3/2001 | Heater et al. | 34/446 |

FOREIGN PATENT DOCUMENTS

JP 408022885 A * 1/1996

* cited by examiner

*Primary Examiner*—Henry Bennett
*Assistant Examiner*—Camtu Nguyen
(74) *Attorney, Agent, or Firm*—Diederiks & Whitelaw, PLC

(57) ABSTRACT

A control system for a clothes dryer includes a control circuit adapted to set the amount of power sent to a main heater of the dryer during various cycles of operation. The control circuit automatically controls the maximum temperature reached in a particular dryer cycle through the use of a thermostat that switches the main heater from a full power setting to a low power setting when the temperature in the dryer reaches a certain maximum preset temperature. By providing low power, rather than no power as the thermostat trips at its preset high temperature, the total drying time required to dry articles of clothing within the dryer is reduced.

19 Claims, 3 Drawing Sheets

CONTROL SYSTEM FOR A CLOTHES DRYER HEATER

BACKGROUND OF THE INVENTION

1. Field of the Invention

The present invention relates to a control system for a clothes dryer and, more particularly, to a clothes dryer including a heater control system configured such that the power supplied to the heater is altered in an efficient manner by cycling the amount of heat supplied by the heater between a high power level and a low power level during a drying operation.

2. Discussion of the Prior Art

It is well known in the art to provide a clothes dryer with a mechanism to control the amount of heat supplied during a drying process. For example, a clothes dryer having a simple time-dry control allows a user to place wet articles inside the dryer and to select both a duration and a temperature setting for the drying process. In such a process, drying simply continues until the set time expires. Typically, in such an operation, the dryer will initially set its electrical heating element to a full power of approximately 5,000 watts. The temperature within the dryer will then rise until it reaches a preset maximum. Thereafter, the dryer will enter a no power mode during which the heating element will be set to zero power. In general, the no power mode has been employed to avoid overheating the articles of clothing. The dryer will then alternate between full power and no power modes until the set time has expired.

In such an operation, the user has no control over what preset maximum power will be provided to the heater of the dryer. Further the amount of heat provided in the no power mode, namely zero power, is also not affected by either the user or the control circuit in prior art devices. This is particularly problematic for delicate clothing which can be easily damaged by high temperatures. To address this potential problem regarding delicate clothing, dryers typically allow for a fluff cycle during which time the heating element is not activated at all. Of course, without any heating, drying times can be excessively long.

It is also well known in the art to provide a clothes dryer with a sensor that automatically controls the drying operation. Essentially, when a sensor dry mode is selected, the user places wet articles inside the dryer drum and selects a desired final dryness level. Instead of forcing the user to guess as to how long the process should take, the machine stops when the desired dryness level is reached. For this purpose, the machine includes at least one moisture sensor for detecting the level of moisture in the articles. The machine simply operates until the moisture sensor detects the final desired dryness level selected. By terminating the process upon achieving the desired final dryness level, there is no need to re-start the drying process to finish incomplete drying. In addition, extra energy is not expended to dry the articles beyond the desired dryness level.

Even with the sensor-dry mode, a typical prior art dryer will have its electrical heating element initially set to full power, again approximately 5,000W. Once again the temperature within the dryer will then rise until it reaches a preset maximum. The dryer will then enter a no power mode during which the heating element will be set to zero power. In a manner similar to the time-dry mode, the dryer will cycle between the heating mode and no power mode until the moisture sensor detects the final desired dryness level selected. Even with the use of a moisture sensor, articles of clothing placed within the drying machine are still subject to a temperature which varies from a high-temperature that may damage some types of clothing, to a low-temperature which is inefficient in that it will not properly dry the clothing in a reasonable amount of time.

Other known dryer arrangements work in a somewhat different manner. For example, U.S. Pat. No. 3,612,500 teaches controlling a first source of heat to establish a high output level for an initial portion of a drying cycle and a second source of heat to establish a lower output level during a subsequent portion of the drying cycle. Specifically, two heater elements are provided, rated at 3,100 and 2,500 watts respectively. During an initial portion of the drying cycle, both heaters are on. However, after the temperature in the drum reaches 160° F., both heaters are turned off and, for the rest of the cycle, only one of the heaters is turned on and off, with a thermostat being used to control the dryer temperature. Even with this modification, the lower power level for the heater equals zero and the upper power level can only be set by the controller to either 5,600 watts or 2,500 watts.

In a similar manner, U.S. Pat. No. 3,508,340 discloses a dryer that provides heating at two power levels. During a first phase of heating, a high power of 4,400 watts is achieved by applying 240 volts to a heating element, while a low power of 1,100 watts is achieved later in the cycle by providing 120 volts to the heating element. Even with this teaching, the power supplied, while the thermostat is cycling, is zero and the upper power can only be set by the controller to either 4,400 watts or 1,100 watts.

Finally, U.S. Pat. No. 2,851,790 also discloses a temperature control system for a dryer. This patent teaches using a variable resistor in series with a bias heater so as to allow for variable adjustment of the output of the bias heater. The bias heater is used to heat a temperature control thermostat so that the thermostat will trip at a lower temperature. Regardless, the main heater still operates at either a high power level or at a no power level.

Based on the above, there exists a need in the art to provide a control system for a clothes dryer which allows for adjustment of the amount of power sent to a heating element of the dryer between various preset levels between full power and no power during a drying operation.

SUMMARY OF THE INVENTION

The present invention is particularly directed to a control system for a clothes dryer including a timer, a temperature sensor, and a circuit which is able to set the amount of power sent to a main heating element of the dryer during various cycles of operation. In accordance with the invention, the circuit automatically controls the maximum temperature reached in the dryer cycle. More specifically, a thermostat is employed to switch a main heater from a full power setting to a low power setting when the temperature in the dryer reaches a certain maximum preset temperature. Adding heat with a bias heater arranged near the thermostat during certain drying cycles changes the actual maximum temperature that the thermostat reacts to. The low power setting for the main heater is provided by switching one set of heating element contacts to neutral rather than turning the heating element completely off by disconnecting it from the power source. The switch returns the heating element to a full power setting by connecting the heating element contacts to different voltage sources when the sensed temperature within the dryer reaches a certain low temperature set point. This feature preferably only remains active during heat cycles, not during a cool down operation.

By providing low power, rather than no power, as the thermostat trips at its preset high temperature, the total drying time required to dry articles of clothing within the dryer is reduced. In any event, additional objects, features and advantages of the invention will become more readily apparent from the following detailed description of preferred embodiments thereof, when taken in conjunction with drawings wherein like reference numerals refer to corresponding parts in the several views.

DETAILED DESCRIPTION OF THE PREFERRED EMBODIMENT

Figure 1:
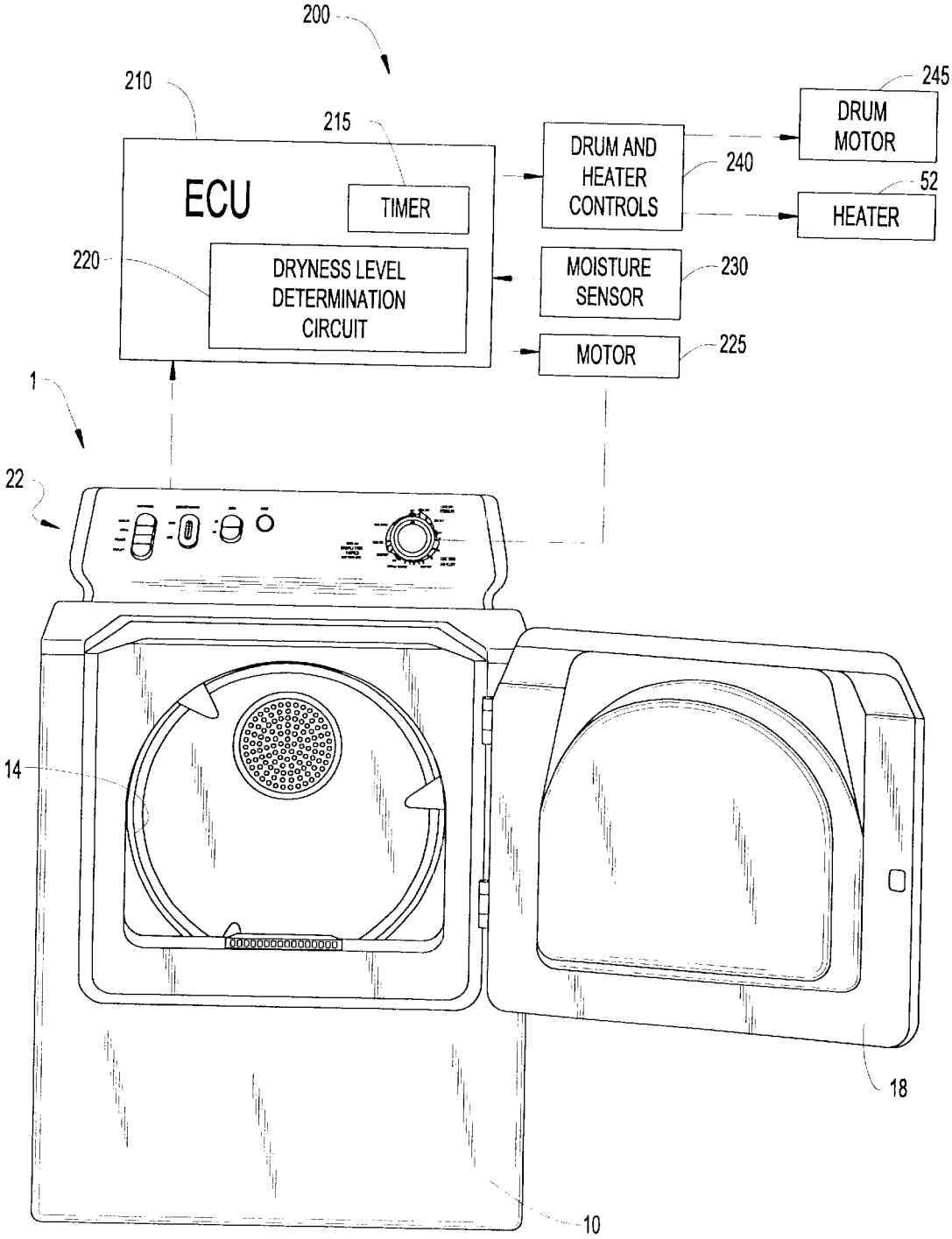
FIG. 1 is a front view of a clothes dryer incorporating a power level control system according to the invention.

A clothes dryer 1 of the present invention is shown in FIG. 1 and generally includes an outer cabinet 10 having a frontal opening leading to a rotatable drum 14 and a door 18 for closing the opening. Disposed on the upper surface of outer cabinet 10 is a control panel 22 for establishing a desired operational sequence for programming clothes dryer 1 of the invention.

Figure 2:
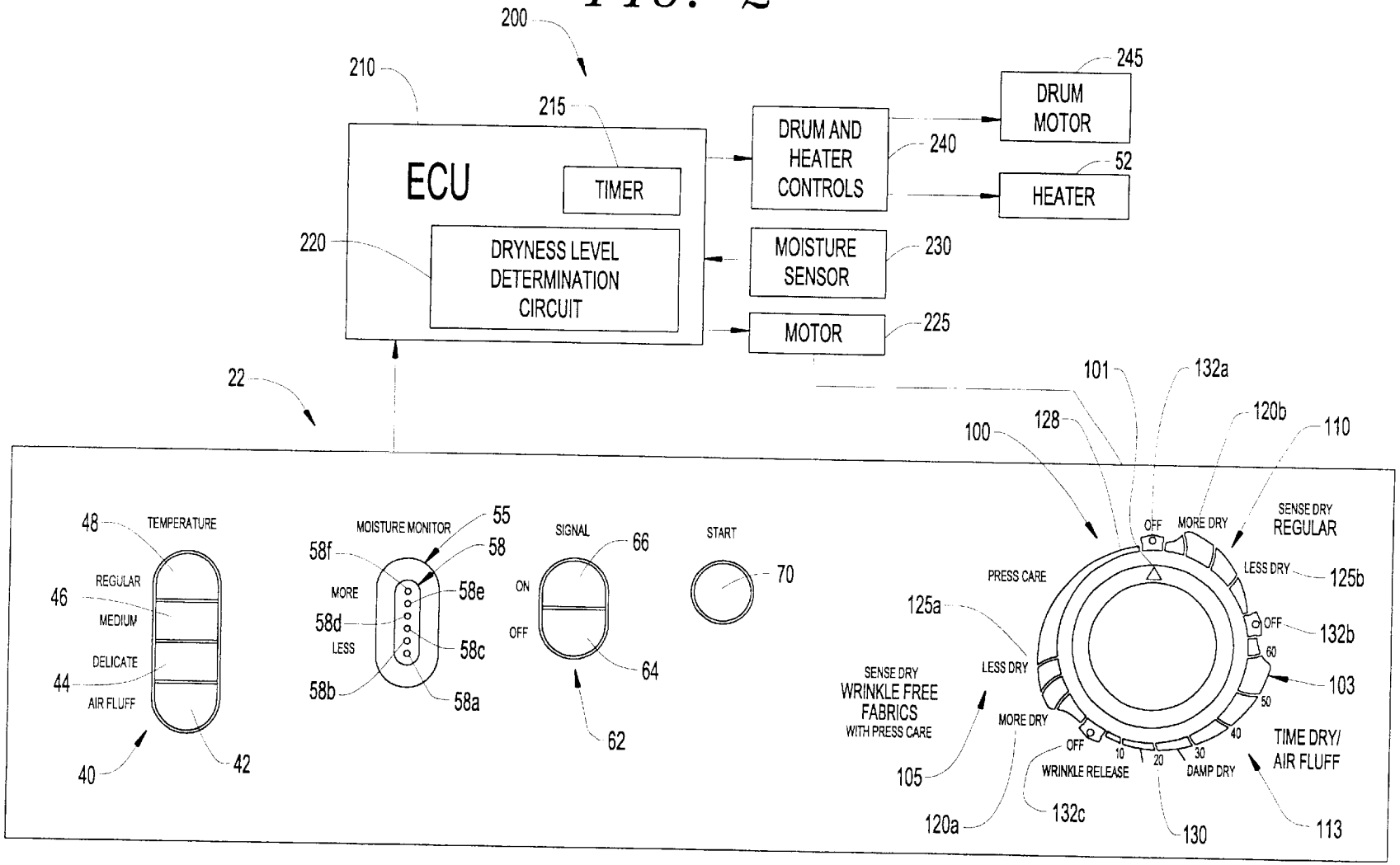
FIG. 2 is a plan view of a control panel provided on the clothes dryer of FIG. 1.

In a manner generally known in the art, and best seen in the enlarged view of FIG. 2, control panel 22 includes a plurality of buttons and other control elements for setting parameters of a desired drying operation for clothes dryer 1. Although control panel 22 is described below in a specific arrangement, it should be understood that the particular arrangement is only exemplary, as a wide range of layouts would suffice. In any event, shown on the left side of control panel 22 is a temperature selector 40 which includes buttons for determining the maximum temperature achievable in drum 14 of clothes dryer 1. In the most preferred embodiment, temperature selector 40 includes an air fluff button 42, a delicate button 44, a medium button 46 and a regular button 48.

Next to temperature selector 40 is a moisture monitor 55 for displaying the current moisture state of articles contained within clothes dryer 1. Moisture monitor 55 is shown as including a set of LED's 58 for indicating specific moisture levels. LED's 58 are shown vertically arranged, whereby the individual LED's 58*a–f* can be illuminated to indicate a current moisture level. For example, illuminating LED 58*a* alone can signify a low moisture level.

Proximate to moisture monitor 55 is a signal controller 62. Signal controller 62 is provided to selectively regulate the operation of a buzzer (not shown), and includes an "off" button 64 and an "on" button 66. The selection of the "on" button 66 causes the buzzer to sound upon completion of the drying operation, while selection of the "off" button 64 prevents the buzzer from sounding upon completion of the drying operation. Additionally, control panel 22 includes a start button 70 for commencing operation of clothes dryer 1.

Finally, control panel 22 includes a control dial 100 for programming clothes dryer 1. Disposed at the center of dial 100 is a location pointer 101 that indicates an established setting for dial 100. Annularly disposed about the periphery of dial 100 are indicia 103 that illustrate the various settings. Specifically, indicia 103 includes a first sensor dry zone 105, a second sensor dry zone 110, and a time-dry zone 113, each defining a portion of indicia 103 and designed to indicate the mode of dryer operation, i.e., a sensor dry mode or a time dry mode. Each of sensor dry zones 105 and 110 includes a respective more dry setting 120*a*, 120*b* and a respective less dry setting 125*a*, 125*b*, with continuous levels there between. First sensor dry zone 105 also includes a press care setting 128. Although not specifically labeled, a cool down sequence is provided at the end of the desired cycle in each zone 105, 110 and 113. A plurality of time increments 130 are defined by indicia 103 in time-dry zone 113. Finally, disposed between each of zones 105, 110 and 113 are off positions 132*a–c*. Depending on the operational state of clothes dryer 1, dial 100, and hence location pointer 101, will reference the appropriate indicia 103.

As indicated in FIG. 1, clothes dryer 1 also includes a control circuit generically indicated at 200. Specifically an ECU (electronic control unit) 210 is provided with a timer 215 and a dryness level determination circuit 220. A motor 225 is provided to drive timer 215 upon direction from ECU 210, or continuously within the time-dry zone 113. A moisture sensor 230 is provided as an additional input to ECU 210. Moisture sensor 230 may be any conventional construction known in the art, such as the moisture sensor described in U.S. Pat. No. 4,477,982 to Cotton, which is hereby incorporated in its entirety by reference. A series of drum and heater controls are collectively represented at 240 which, when directed by ECU 210, function to rotate drum 14 through drum motor 245 and regulate heating element 52 in response to a drying profile set through control panel 22 and the output from ECU 210.

Figure 3:
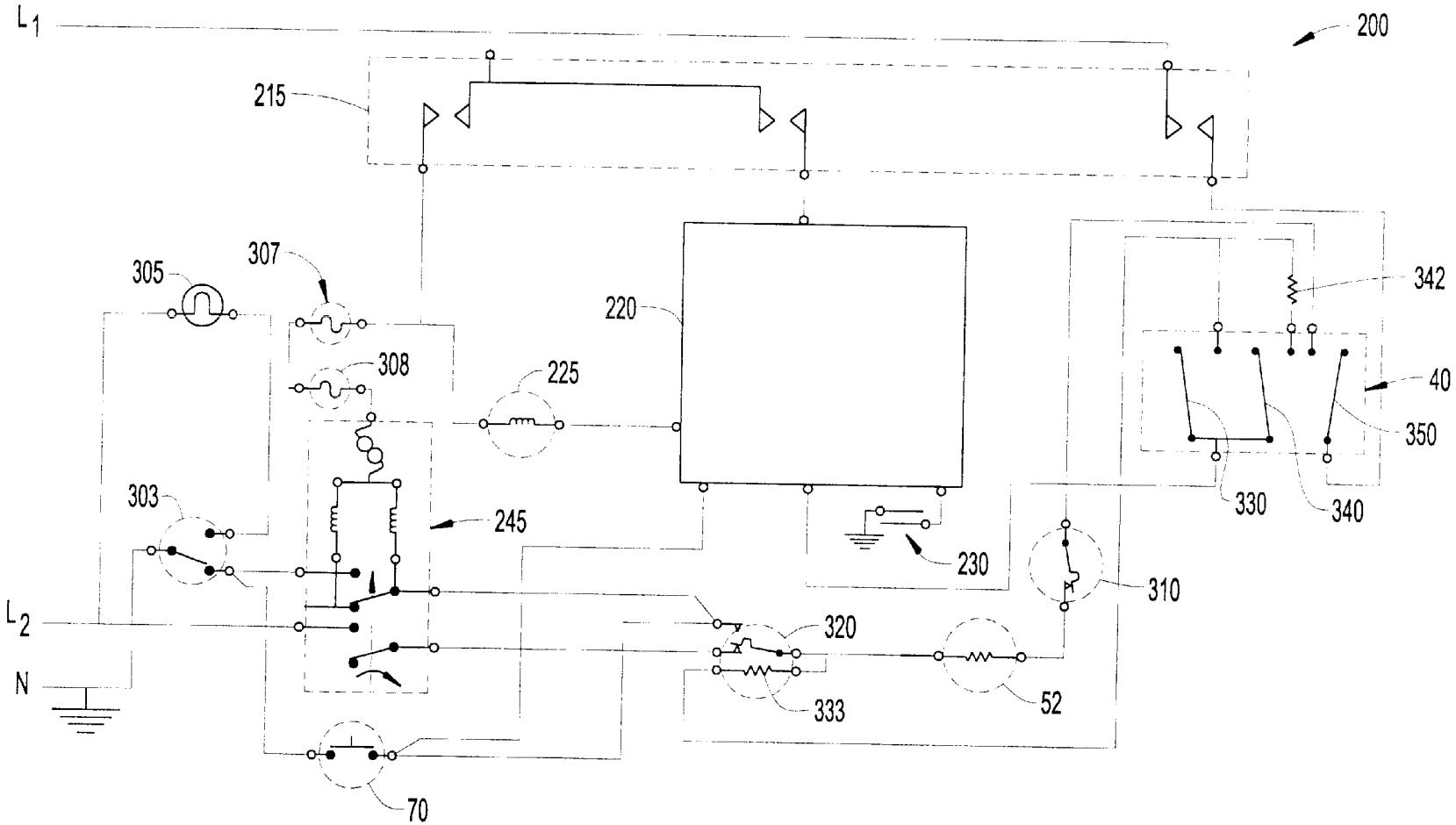
FIG. 3 is a control circuit diagram according to the preferred embodiment of the invention.

Turning now to FIG. 3 which shows a general electrical circuit constructed in accordance with the most preferred embodiment of the invention, the details of the electric control structure and operation will now be discussed. For purposes of this discussion, dryer 1 is connected to a household power supply, i.e., a typical household, three wire 240 volt supply wherein two wires provide 120 volts of electricity with potentials that are opposite from one another and a third wire is neutral or, in other words, connected to ground. As can be seen in the left-hand side of FIG. 3, a terminal block having terminals L1, L2 and neutral is provided. A 240 volt potential is therefore provided across terminals L1 and L2, while a 120 volt potential may be provided between either L1 and neutral or L2 and neutral.

As shown, control circuit 200 comprises a door operated switch 303 generally connected in series with N. Door switch 303 is designed to prevent operation of dryer 1 when door 18 is in the open position. Additionally, when door 18 is in the open position, door switch 303 will provide power to lamp 305 which will illuminate the inside of drum 14, thereby making it easier to load and unload clothing. Control circuit 200 also includes push-to-start button or switch 70, drum drive motor 245, and timing device 215. A pair of fuses 307 and 308, dryness level control circuit 220, temperature selector 40, a high limit thermostat 310, main heater 52, and a cycling thermostat 320 complete the basic control circuit 200.

As stated above, when door switch 303 is in the open condition, power is delivered to interior lamp 305, but not to drive motor 245 or other portions of circuit 200. However, when door 18 is closed, switch 303 allows power to both drive motor 245 and push-to-start switch 70. When push-to-start switch 70 is pushed for a certain amount of time by an operator, power is then sent further along circuit 200 to dryness level determination circuit 220 and, in addition, to cycling thermostat 320. Dryness level determination circuit 220 and timer motor 225 generally operate as conventional in the art. Basically, the overall timer system includes timer motor 225 and a plurality of both movable and fixed contacts so that, as timer 215 cycles through various operations of dryer 1 according to a fixed schedule, different contacts are sequentially engaged or disengaged. As this is well known in the art, further details of timer motor 225 will not be described here. The two fuses 307 and 308 are placed between timer 215 and drive motor 245 as shown in the drawing. Fuses 307 and 308 are simply there for safety purposes and will, as well known in the art, disconnect power from drive motor 245 in overload conditions.

Turning now to temperature selector 40, as noted above, temperature selector 40 has four basic settings, i.e., regular, medium, delicate and air fluff. Basically, temperature selector 40 includes three internal switches, each having associated "on" and "off" positions. The first internal switch essentially constitutes a high bias switch 330 for cycling thermostat 320. When the high bias switch 330 is "on", it provides power to a biasing heater 333. Biasing heater 333 causes cycling thermostat 320 to trip at a relatively low set point or at least trip when the clothes in dryer 1 are at a relatively low temperature compared to when high bias switch 330 is in the "off" position. In the "off" position, high bias switch 330 provides no current to biasing heater 333.

The second internal switch is constituted by a low bias switch 340 for cycling thermostat 320. When low bias switch 340 is "on", it provides power to biasing heater 333 much like high bias switch 330. However low bias switch 340 sends current through a resistor 342 before the current reaches biasing heater 333. Therefore biasing heater 333 produces less heat through low bias switch 340 than when it is activated by high bias switch 330. When low bias switch 340 assumes an "on" position, biasing heater 333 causes cycling thermostat 320 to trip at a relatively low set point or at least trip when clothes in dryer 1 are at a relatively low temperature compared to when low bias switch 340 is in the "off" position. Of course thermostat 320 will trip at a relatively high set point through low bias switch 340 as compared to when it receives power from high bias switch 330. In the "off" position, low bias switch 340 provides no current to biasing heater 333.

The third internal switch is essentially a main heater switch 350. When main heater switch 350 is "on", power may travel from timer 215 to cycling high limit thermostat 310 and then main heater 52. If main heater switch 350 is set to "off", no power will be sent to main heater 52.

In a regular setting, high bias switch 330 and low bias switch 340 are "off", and main heater switch 350 is "on". As a result, cycling thermostat 320 is not biased and trips at a high clothing temperature. Furthermore, power is supplied to main heater 52. In a medium setting, high bias switch 330 is "off", low bias switch 340 is "on", and main heater switch 350 is "on". As a result, power is supplied to main heater 52, while cycling thermostat 320 is biased slightly and trips at a medium clothes temperature. In a delicate setting, high bias switch 330 is "on", low bias switch 340 is "off", and main heater switch 350 is "on". As a result, cycling thermostat 320 is highly biased and trips at a low clothes temperature to protect the delicate clothes. Finally, in an air fluff setting, high bias switch 330 and low bias switch 340 are "off", and main heater switch 350 is "off". No power is supplied to biasing heater 333, but it is of no consequence because no power is supplied to main heater 52 and the clothes are just rotated in the drum 14 as air is blown through them.

As noted above, when the third internal switch, i.e., main heater switch 350, is in the "on" position, power is sent through cycling thermostat 320, high limit thermostat 310, and main heater 52. Hi-limit thermostat 310 normally stays in the closed position. Only in unusual or emergency conditions will the temperature get so high as to trip hi-limit thermostat 310. In this way, hi-limit thermostat 310 acts as a safety device and shuts down power to main heater 52 when the temperature in dryer 1 reaches unusually high temperatures. In the most preferred embodiment, main heater 52 is an electric resistance heater which will change the amount of heat produced as a function of the square of the voltage applied, as is well known in the art. However, other heater arrangements could be employed.

As shown, thermostat 320 is connected to L1 through heater 52 at one terminal and to either L2, when in a normal mode, or to neutral, when in a tripped mode. It is important to note that the key concept is to have heater 52 subjected to a high voltage in regular mode and a low voltage in a tripped mode. More specifically, thermostat 320 is preferably connected to L2 through drum motor 245 directly in one mode, thereby providing 240 volts to main heater 52. Thermostat 320 is connected to neutral through drum motor 245 and door switch 303 in a second mode, thus providing 120 volts to main heater 52 when thermostat 320 trips into a second mode. In the most preferred form of the invention, heater 52 will normally produce about 5,150 watts when subjected to 240 volts and only produce about 1,280 watts when subjected to 120 volts.

The operation of dryer 1 will now be described. After wet articles are placed within drum 14, a user selects a desired drying operation wherein temperature selector 40 is used to choose a desired operating temperature for clothes dryer 1. While selecting regular button 48 establishes the highest temperature setting and results in the fastest drying time, the "regular" setting may be too hot for some articles. Therefore, as discussed above, additional temperature levels such as medium, delicate, and air fluff are provided. The choice of which button is pushed in temperature selector 40 causes the appropriate internal switches 330, 340 and 350 to be set as described above. Before pressing start button 70 and beginning operation of clothes dryer 1, the user rotates dial 100 from a respective off setting 132*a–c* into time-dry zone 113, sensor dry zone 105, or second sensor dry zone 110.

If dial 100 is rotated such that location pointer 101 is in time-dry zone 113, clothes dryer 1 will operate until the time indicated by a time increment 130 expires. ECU 210 directs motor 225 to rotate dial 100 at a relatively slow speed through a reduced duty cycle coinciding to time increments 130, and operates heater 52 based in part upon the temperature chosen via temperature selector 40 as described above.

More specifically as heater 52 raises the temperature of the clothes, thermostat 320 reaches an upper temperature limit and trips to control heater 52. When the temperature has sufficiently cooled, thermostat 320 switches again and returns heater 52 back to full power. As thermostat 320 trips, heater 52 is switched from a high power setting to a low power setting, rather than from a conventional high power setting to a no power setting. The result is a lower amount of total drying time because heat is still added to the dryer during cycling thermostat trips. Therefore, in accordance with this embodiment, the rate at which the temperature decreases from shortly after a maximum temperature trip point to a low temperature trip point is reduced. The control unit cycles in this manner and rotation of drum 14 continues until location pointer 101 reaches "off" setting 132*c*. If desired, moisture sensor 230 could be designed to operate during the time-dry mode to display to the user the current moisture level via moisture monitor 55, even though the sensor dry mode was not selected. In either sensor-dry mode, dryer 1 will run until the dryness level selected by rotating dial 100 is sensed by moisture sensor 230. The rest of the drying operation in either sensor-dry mode is the same as in the time dry mode.

Although described with reference to a preferred embodiment of the invention, it should be readily understood that various changes and/or modifications can be made to the invention without departing from the spirit thereof. For example, although the power level to heater 52 is automatically adjusted between upper and lower power levels in accordance with the most preferred form of the invention, additional levels could be established, such as by employing a user setting device in the form of control buttons or the like such as disclosed in U.S. Patent Application entitled "Heater Control System for a Clothes Dryer" filed on even date herewith and incorporated by reference. In general, the invention is only intended to be limited by the scope of the following claims.

We claim:

1. A clothes dryer comprising:

an outer cabinet shell;

a rotatable drum mounted within said outer cabinet shell, said drum being adapted to receive articles of clothing to be heated and dried during a drying operation;

a heater for heating the articles of clothing; and a control circuit for cyclically switching the heater, at least twice during the drying operation, between a first condition, wherein the heater produces a first amount of heat, and a second condition, wherein the heater produces a second amount of heat, said second amount of heat being less than said first amount of heat, but greater than zero.

2. The clothes dryer according to claim 1, wherein said control circuit includes a thermostat for switching the heater from said first condition to said second condition at a first measured temperature and from said second condition to said first condition at a second measured temperature.

3. The clothes dryer according to claim 1, wherein said control circuit changes the condition of said heater by changing the amount of voltage applied to the heater.

4. The clothes dryer according to claim 3, wherein said amount of voltage applied to the heater is approximately 240 volts in a first condition and approximately 120 volts in a second condition.

5. The clothes dryer according to claim 2, wherein the control circuit further comprises:

a biasing heater arranged adjacent to said thermostat, and a first bias switch movable between first and second positions wherein, when the first bias switch is in the first position, said biasing heater is powered to cause said thermostat to trip at a temperature which is lower than when the first bias switch is in the second position.

6. The clothes dryer according to claim 5, wherein said biasing heater is not powered through the first bias switch when the first bias switch is in the second position.

7. The clothes dryer according to claim 5, wherein the control circuit further comprises:

a resistor; and a second bias switch movable between first and second positions wherein, when the second bias switch is in the first position, said biasing heater is powered through the resistor to cause said thermostat to trip at a temperature which is lower than when the second bias switch is in the second position.

8. A clothes dryer comprising:

an outer cabinet shell;

a drum rotatably mounted within said outer cabinet shell, said drum being adapted to receive articles of clothing to be heated and dried within said drum during a drying operation;

a main heater for heating the articles of clothing; and a control circuit, including a thermostat, for cyclically changing the main heater between first and second operational states at first and second operational temperatures at least twice during the drying operation, wherein said main heater is powered in each of the first and second operational states.

9. The clothes dryer according to claim 8, wherein the control circuit further comprises:

a biasing heater arranged adjacent to said thermostat, and a first bias switch movable between first and second positions wherein, when the first bias switch is in the first position, said biasing heater is powered to cause said thermostat to trip at a temperature which is lower than when the first bias switch is in the second position.

10. The clothes dryer according to claim 9, wherein said biasing heater is not powered through the first bias switch when the first bias switch is in the second position.

11. The clothes dryer according to claim 9, wherein the control circuit further comprises:

a resistor; and a second bias switch movable between first and second positions wherein, when the second bias switch is in the first position, said biasing heater is powered through the resistor to cause said thermostat to trip at a temperature which is lower than when the second bias switch is in the second position.

12. The clothes dryer according to claim 9, wherein said control circuit automatically changes the main heater between the first and second operational states by changing the amount of voltage applied to the main heater.

13. The clothes dryer according to claim 12, wherein said amount of voltage applied to the main heater is approximately 240 volts in the first operational state and 120 volts in the second operational state.

14. A method of performing a drying operation on articles of clothing within a drum of a clothes dryer comprising:

setting a drying temperature for the drying operation; and varying an amount of heat supplied by a heater of the clothes dryer in a cyclical manner, at least twice during the drying operation, from a first condition, wherein the heater produces a first amount of heat, to a second condition, wherein the heater produces a second amount of heat, said second amount of heat being less than said first amount of heat, but greater than zero.

15. The method of claim 14, further comprising: measuring a temperature within the clothes dryer and switching the heater between the first and second conditions based on said temperature.

16. The method of claim 14, further comprising: changing an amount of voltage applied to the heater by applying an approximately 240 volt differential during the first condition and applying an approximately 120 volt differential to the heater during the second condition.

17. The method of claim 14, further comprising:

activating a biasing heater arranged adjacent to a thermostat used to switch the heater between the first and second conditions; and shifting a first bias switch between first and second positions wherein, when the first bias switch is in the first position, said biasing heater is powered to cause said thermostat to trip at a temperature which is lower than when the first bias switch is in the second position.

18. The method of claim 17, further comprising: deactivating said biasing heater through the first bias switch when the first bias switch is in the second position.

19. The method of claim 18, further comprising: shifting a second bias switch between first and second positions wherein, when the second bias switch is in the first position, said biasing heater causes said thermostat to trip at a temperature which is lower than when the second bias switch is in the second position.

* * * * *